US006186239B1

(12) United States Patent
Monjure et al.

(10) Patent No.: US 6,186,239 B1
(45) Date of Patent: Feb. 13, 2001

(54) CASING ANNULUS REMEDIATION SYSTEM

(75) Inventors: Noel A. Monjure, Houston, TX (US); Kenneth Sikes, Sr., Marrero, LA (US); David D. Comeaux, Sugarland, TX (US); Francis R. Bobbie, Houston, TX (US); Ralph Lewis Ropp, Dallas, TX (US)

(73) Assignees: ABB Vetco Gray Inc., Houston, TX (US); Shell Offshore, Inc., New Orleans, LA (US)

( * ) Notice: Under 35 U.S.C. 154(b), the term of this patent shall be extended for 0 days.

(21) Appl. No.: 09/356,724

(22) Filed: Jul. 20, 1999

Related U.S. Application Data

(63) Continuation-in-part of application No. 09/078,230, filed on May 13, 1998, now Pat. No. 5,927,405.

(51) Int. Cl.[7] ..... E21B 19/08

(52) U.S. Cl. ..... 166/384; 166/77.1; 166/90.1; 166/97.1; 166/242.2; 166/242.5; 166/325; 166/379

(58) Field of Search ..... 166/242.1, 242.2, 166/384, 385, 381, 317, 50, 90.1, 97.5, 77.1–77.3, 277, 325, 222, 312, 379, 97.1, 242.5; 137/540

(56) References Cited

U.S. PATENT DOCUMENTS

| | | | | |
|---|---|---|---|---|
| 3,087,551 | * | 4/1963 | Kerver | 166/224 |
| 3,814,179 | * | 6/1974 | Hull, Jr. | 166/97.1 |
| 4,754,810 | | 7/1988 | Bennett et al. | 166/253 |
| 4,844,166 | | 7/1989 | Going, III et al. | 166/379 |
| 4,972,904 | | 11/1990 | Godare | 166/77 |
| 4,997,042 | * | 3/1991 | Jordan et al. | 166/379 |
| 5,018,583 | | 5/1991 | Williams | 166/385 |
| 5,172,765 | | 12/1992 | Sas-Jaworsky et al. | 166/384 |
| 5,236,036 | | 8/1993 | Ungemach et al. | 166/77 |
| 5,284,210 | | 2/1994 | Helms et al. | 166/385 |
| 5,348,096 | | 9/1994 | Williams | 166/384 |
| 5,511,617 | | 4/1996 | Snider et al. | 166/291 |
| 5,845,711 | * | 12/1998 | Connell et al. | 166/384 |
| 6,047,776 | * | 4/2000 | Kiang et al. | 166/379 |

* cited by examiner

*Primary Examiner*—Hoang Dang
(74) *Attorney, Agent, or Firm*—Felsman, Bradley, Vaden, Gunter & Dillon, L.L.P.; James E. Bradley

(57) ABSTRACT

A casing annulus remediation system for lowering a flexible hose into an annulus between strings of casing in a petroleum well by pressurizing the hose so that the hose is rigid and may be forced down the annulus. It is necessary to insert the hose through an outlet into the annulus region for well fluid displacement when pressure builds up in the annulus between casing strings due to leaks in the casing. Pressure build-up in the annulus is reduced by pumping a heavy liquid, sealant or other media through the hose into the annular space experiencing the pressure build-up. A tubing nose is affixed to the lower end of the hose. The hose may be inserted hundreds of feet into the well. Therefore, the hose is pressurized to maintain rigidity to keep the hose from winding about the well during deployment. To keep the hose rigid, internal pressure is maintained in the hose. The tubing nose is provided with a check valve that holds the pressure. Once the hose is lowered to a desired depth, an operator may increase the pressure sufficiently in the hose to open the check valve, thereby allowing heavy liquid to flow out. The heavy liquid displaces the lighter well product, which flows out of the outlet. A terminal fitting assembly is attached to an upper end of the hose and is secured within an access port in the wellhead member. The terminal fitting assembly has a check valve therein, and the hose may be left in the tubing head assembly so that fluids may be pumped through the hose at selected time thereafter.

20 Claims, 6 Drawing Sheets

CASING ANNULUS REMEDIATION SYSTEM

CROSS-REFERENCE TO RELATED APPLICATIONS

This application is a continuation-in-part of patent application Ser. No. 09/078,230, filed May 13, 1998 in the United States Patent & Trademark Office, which issued as U.S. Pat. No. 5,927,405.

TECHNICAL FIELD

This invention relates in general to well remediation systems and in particular to the process and components used for filling an annulus in a well with heavy liquid sealant, or other media, to control or eliminate sustained casing pressure in outer casing string.

BACKGROUND OF THE INVENTION

In wells drilled for petroleum production, a plurality of well casings of different sizes are suspended from a wellhead. A problem encountered in such wells is that of annular pressure control. In the annulus between different casing sizes, pressure may develop due to leaks between strings of casing, tubing leaks, packer leaks, wellhead packoff leaks and a poor or failed primary cement job. Currently, to control the annular pressure, a relatively heavy liquid is pumped into the annulus at the upper end of the well. The heavy liquid migrates slowly downward, displacing lighter liquid. This technique is expensive, time consuming and has yielded limited results.

BRIEF SUMMARY OF THE INVENTION

A system is needed that inserts a fluid delivery system through an existing wellhead or tubing head assembly into a constricted and pressurized annulus and transports the fluid delivery system far enough downhole to achieve the needed hydrostatic column for pressure control. The fluid delivery system delivers a suitable fluid or other media to establish permanent hydraulic control and to provide a simple method of renewal if necessary.

In this system, a flexible hose is lowered into an annulus between strings of casing to depths of 1200 feet or more. The flexible hose is preferably elastomeric, but may be made of metallic, composite or other suitable materials. A nozzle is affixed to the lower end of the hose. The hose must be pressurized and rigid to keep the hose from winding about the well during insertion. To keep the hose rigid, internal pressure is maintained in the hose. The nozzle is provided with a closure member such as a pressure relief valve, burst disk, or other suitable device that holds the pressure within the hose. Once the hose is lowered to a desired depth, the operator increases the pressure sufficiently in the hose to open the closure member, e.g., break the disk or open the valve, thereby allowing heavy liquid to flow out. The heavy liquid displaces the lighter well production fluids. An injection sealer at the surface seals around the hose. A gate valve is employed to shear the hose in the event of an emergency.

BEST MODE FOR CARRYING OUT THE INVENTION

Figure 1:
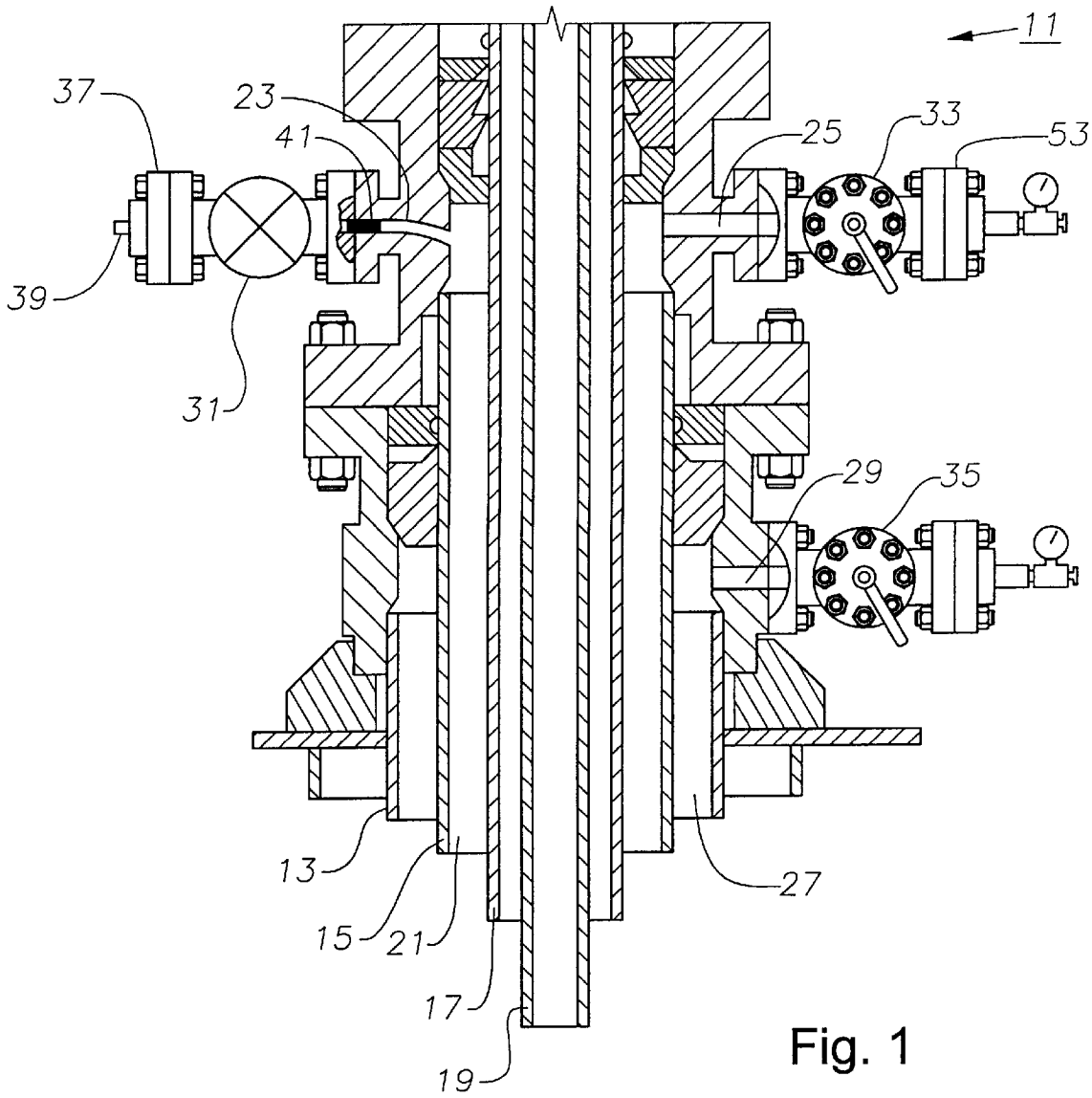
FIG. 1 is a sectional side view of a typical tubing head.

Referring to FIG. 1, a wellhead such as tubing head 11 having multiple strings of casing 13, 15, 17, 19 suspended therefrom is shown. A longitudinal annulus extends between each pair of adjacent strings of casing. Each annulus has at least one access port at tubing head 11. For example, annulus 21 extends between casing strings 15 and 17, and has access ports 23, 25, while annulus 27 extends between casing strings 13 and 15, and has access port 29. Conventional valves 31, 33 and 35 control flow through ports 23, 25 and 29, respectively. A companion flange 37 and bull plug 39 are located on casing valve 31.

A companion flange 53 is attached to conventional valve 33. A discharge manifold 59 (FIG. 2) is connected to companion flange 53. Discharge manifold 59 communicates with gas separator assembly 61. Gas separator assembly 61 has a cutting box 63 and a gas separator 65.

Figure 2:
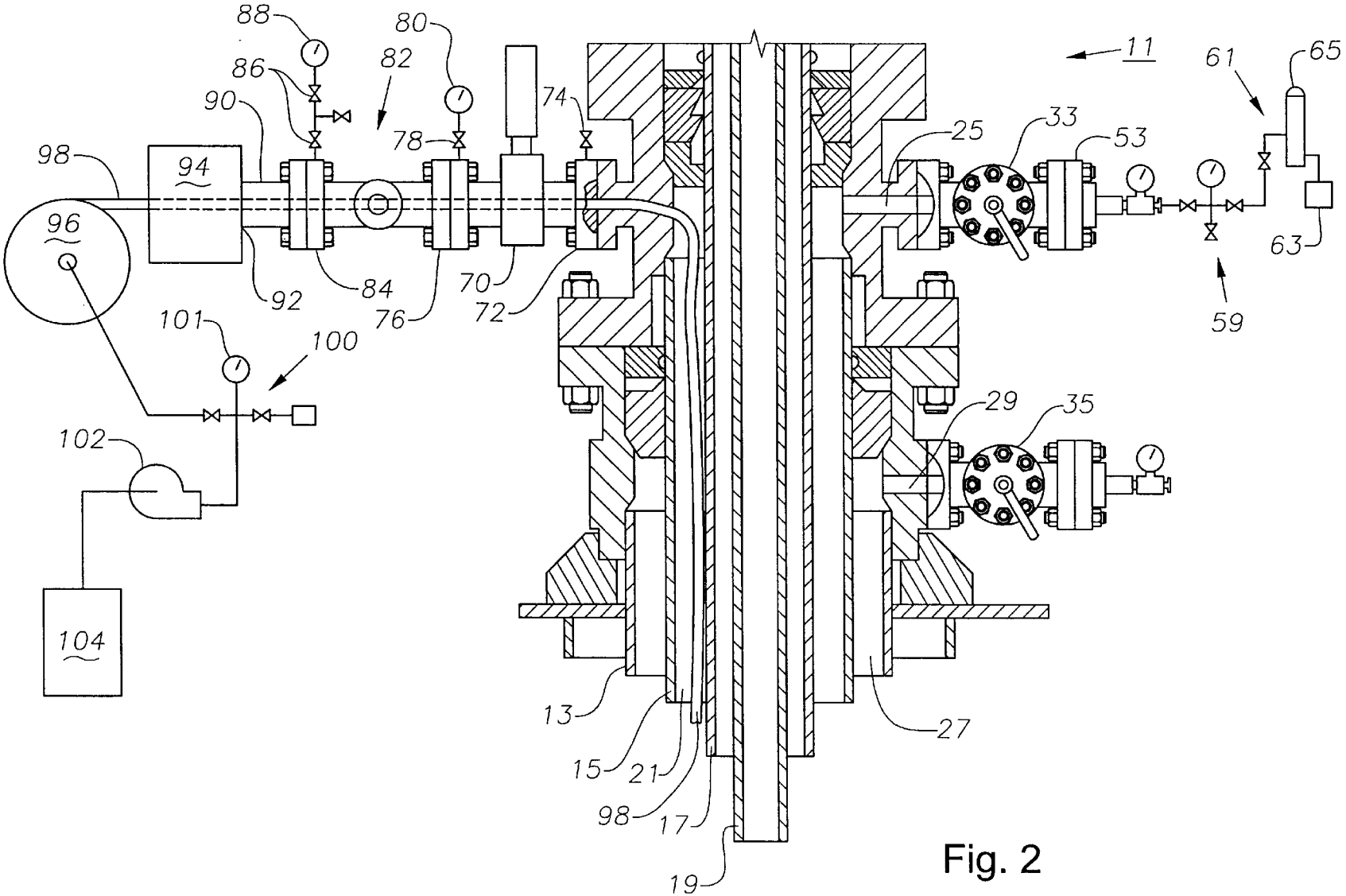
FIG. 2 is a sectional side view of the tubing head of FIG. 1 having an assembly for facilitating a remediation system attached thereto, showing a flexible hose inserted within the tubing head.

To install a remediation system, referring still to FIG. 1, companion flange 37 and bull plug 39 are removed from casing valve 31. A solid valve removal plug 41 is installed in port 23 using a method known in the art and discussed below. Valve 31 is then removed and replaced with shear valve 70 (FIG. 2) having a fail safe closed system. Referring to FIG. 2, the shear valve 70 preferably has an inside instrument flange 72, having a needle valve 74 installed thereon. Shear valve 70 preferably has a hydraulically activated fail closed system. On outside flange 76, a needle valve 78 and gage 80 are installed. Local hydraulics should then be rigged up to energize the fail safe closed system on shear valve 70.

A blowout preventer (BOP) 82 is flanged onto shear valve 70. The BOP 82 should have an instrument flange 84 with needle valves 86 and pressure gage 88 to monitor pressure when rams in BOP 82 are closed.

A packoff 90 connects to BOP 82. Packoff connection 92 connects to an injector head 94. A hose reel 96 stores hose 98. Manifold 100 communicates with hose 98 through reel 96. Pump 102 communicates with hose 98 via manifold 100. Manifold 100 is preferably equipped with pressure gage 101. Pump 102 is provided to pump out contents of tank 104.

Figure 3:
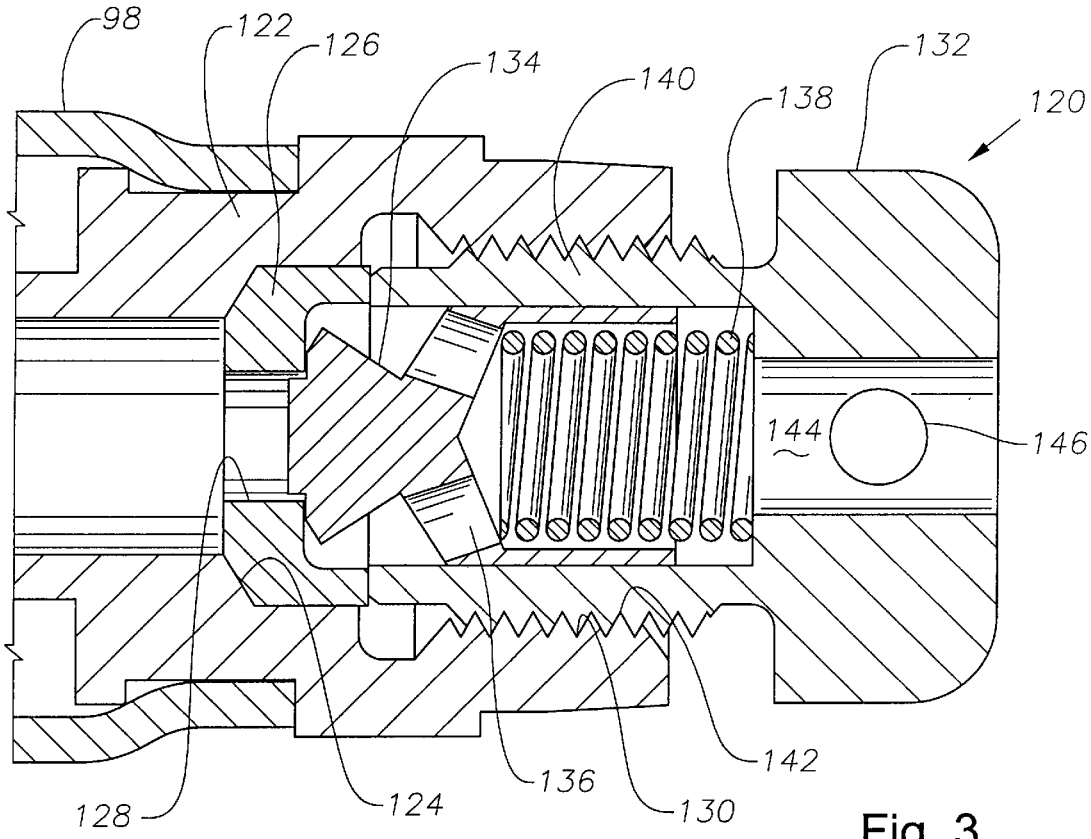
FIG. 3 is an enlarged view of a tubing nose for installation on an end of the tubing.

Referring now to FIG. 3, a tubing nose 120 is shown. Tubing nose 120 consists of a hose connector body 122. Preferably, hose connector body 122 is affixed to hose 98 by crimping a metallic sleeve provided on the terminal end of hose 98. Hose connector body 122 has a receptacle 124 that receives a valve seat 126 therein. Valve seat 126 has a centrally located orifice 128. Hose connector body 122 has internal threads 130 for threadably receiving contoured tip 132. Valve member 134 is biased against orifice 128 of valve seat 126. Valve member 134 has a head with a plurality of slots 136 that allow fluid to pass through valve member 134.

Valve member 134 engages spring 138. Spring 138 biases against an inner surface of contoured tip 132 and forces valve member 134 against orifice 128. Spring 138 preferably is rated for 600 PSI. Contoured tip 132 has a stem 140, which has external threads 142 for engaging internal threads 130 of hose connector body 122. Contoured tip 132 has a central orifice 144 and a plurality of radially extending passages 146. An articulated weight device (not shown) may be to tubing nose 120 to assist in installing tubing nose 120 in tubing head 11. Tubing nose 120 is disclosed in co-pending application Ser. No. 09/356,717, incorporated herein by reference.

Tubing nose 120 on the terminal end of hose 98 is then manually run through injector head 94, packoff 90 and inside of BOP 82 (FIG. 2). The rams of BOP 82 are then closed. At this time, all connections, including the rams of BOP 82 are tested. Testing is preferably conducted at 100 PSI over a maximum expected casing pressure.

Figure 4:
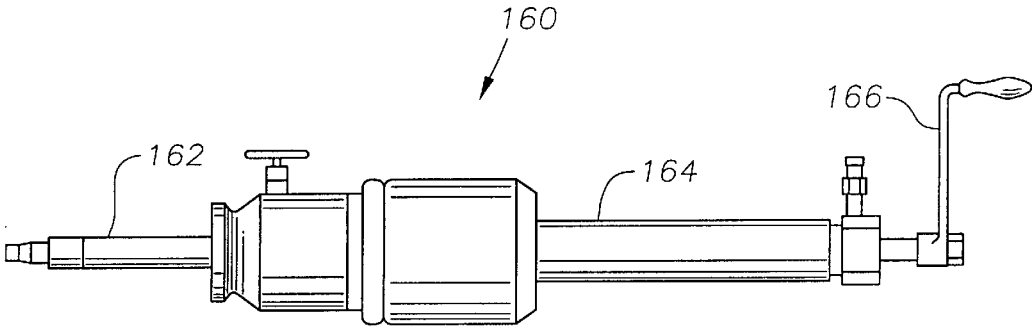
FIG. 4 is a schematic view of a valve removal tool.

Once connection testing is completed, the rams of BOP 82 are opened and hose 98 is removed. Valve removal tool 160 (FIG. 4) is then attached to BOP 82 and is used to pull valve removal plug 41 (FIG. 2) in a manner known in the art. A typical valve removal tool 160 has two stems, a traveling stem 162 and a tong stem 164. Rotating the tong stem 164 also rotates the traveling stem 162, which is keyed to the tong stem 164. Preferably, turning the screw stem 166 clockwise causes the traveling stem 162 to extend or reach out. Turning the screw stem 166 counterclockwise causes the traveling stem 162 to retract. Turning both stems 162 and 164 at the same time results in both rotation and axial movement of the traveling stem 162. In this manner it is possible to engage and set or remove the threaded valve removal plug 41 through BOP 82. After pulling the valve removal plug 41, the valve removal tool 160 is then rigged down and shear valve 70 (FIG. 2) is closed.

Referring back to FIG. 2, at this time, the distance from packoff 90 to the inside of the gate of shear valve 70 is measured to "zero out" the depth of hose 98 before injecting hose 98. A test is then performed between packoff connection 92 and closed shear valve 70. To test effectively, 200 PSI is applied on the inside of hose 98. This pressure will expand the hose out to seal onto packoff 90. The preferred check valve threshold operating pressure is 600 PSI. A test pressure is then applied. Pressure should be 100 PSI over the maximum casing pressure expected. The test pressure is applied through the instrument flange 84 on BOP 82.

As will be explained later, a terminal fitting assembly 180 (FIG. 5) will be installed on the surface end of hose 98. Terminal assembly 180 (FIG. 5), preferably an Aeroquip modified part number FC 5805-0606 or equivalent is crimped with a field crimp 182 onto a first cut end 184 (FIG. 7) of a tubing head section of hose 98 after hose 98 is severed, as will be explained later. Terminal fitting assembly 180 has a valve crimp body 188 that threads into terminal fitting body 190. Valve crimp body 188 receives crimped first cut end 184 of a section of hose 98 that extends from tubing head 11. Terminal fitting body 190 has a nose 192 having an orifice 194 with internal threads 196 therein. A check valve stem 198 has a tool receptor 200 on a first end and a seating head 202 on a second end. Spring 204 biases check valve stem 198 towards the first end, thereby forming a seal with seating head 202. Terminal fitting assembly 180 will subsequently land and seal in access passage 23 (FIG. 1). Outer threads 205 are provided to sealingly engage internal threads in access passage 23.

For testing purposes, an NPTX swivel fitting may be attached to a second cut end 222 (FIG. 7) of a section of hose 98 extending from reel 96 and an NPTX box prep is attached in the outer NPTX female profile fitting that is screwed into internal threads 196 of nose 192.

Figure 6:
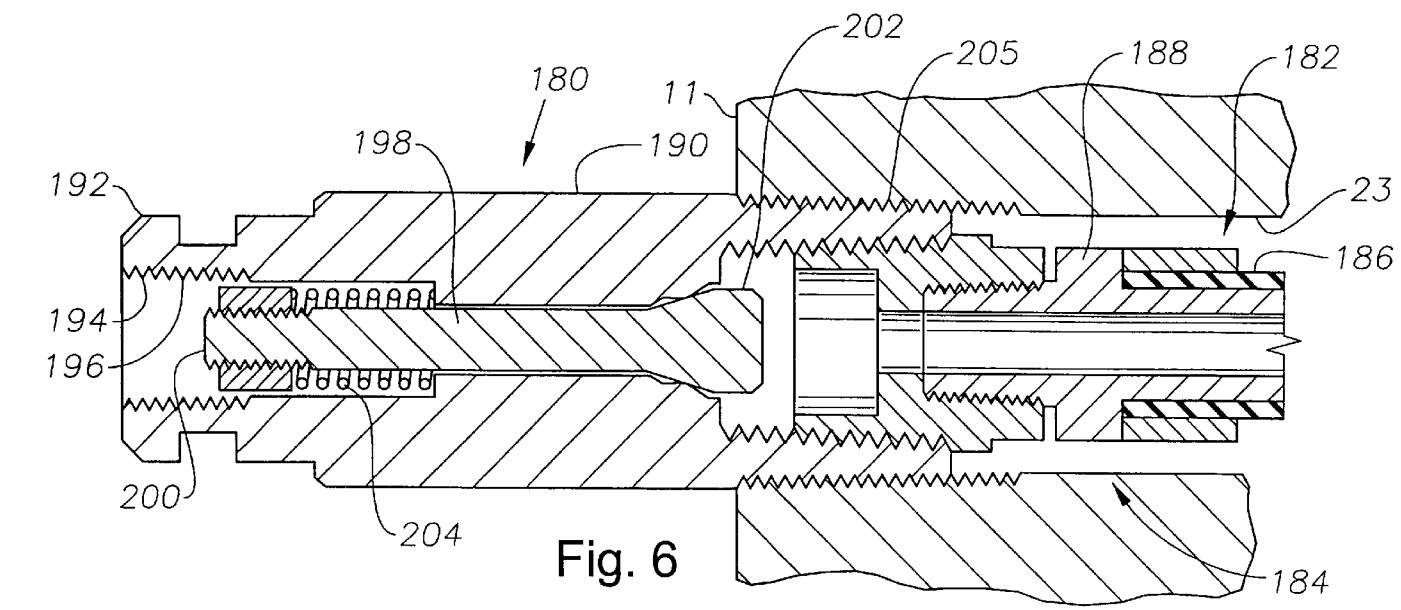
FIG. 6 is a sectional side view of the terminal fitting assembly of FIG. 5 installed within an access port in the tubing head of FIG. 1.

Referring now to FIG. 6, terminal fitting assembly 180 is shown installed within access passage 23 of tubing head 11. Outer threads 205 are engaging threads provided within access passage 23.

After testing, the following operating procedure may be executed. Valve 33 (FIG. 2), which is in communication with discharge outlet 25, is opened. Casing pressure from casing annulus 21 is reduced by flowing to gas separator 65 or cutting box 63. Shear valve 70 is then opened slowly. Packing elements in packoff spool 90 are checked for any leaks. Pressure is slowly bled off from injection hose 98 while checking packoff 90 for leaks.

After checking for leaks, flexible hose 98 is pushed forward by injector head 94 until tubing nose 120, which is affixed to the lower end of hose 98, contacts the outside diameter of casing 17. Continued pushing on flexible hose 98 insures that approximately one to two feet of hose 98 enters casing annulus 21. While pushing hose 98, the inside of hose 98 should not be pressurized yet, so that hose 98 may make the sharp turn in the tubing head 11 necessary to travel down the casing annulus 21.

Pump 102 is then engaged to pump a fresh water from tank 104 into hose 98 to pressurize hose 98. Typically, hose 98 is pressurized to at least 250 PSI, however, this is less than the pressure required to open pressure valve 120 (FIG. 3) on the nose of hose 98. There will be no discharge from hose 98 at this point. Injection of flexible hose 98 into casing annulus 21 is continued until the projected depth is reached, which is typically the top of cement or other obstruction in the annulus. The injection is handled by an injection device (not shown) that grips and pushes hose 98 into the casing annulus. The depth may be 1200 feet or more.

An initial depth reading is obtained. The depth of the tubing nose 120 may be determined by using a radioactive tracer. Based on the depth to the end of hose 98, a volume of the annulus from the end of the hose 98 to the surface is calculated. Pressure is then bled off of the inside of hose 98 above tubing nose 120 manifold 100 located between tank 104 and hose reel 96 (FIG. 2). The hose 98 is then locked into place with BOP 82. Pressure is bled off between BOP 82 and packoff 90 through needle valve 86 on instrument flange 84 of BOP 82.

At this point, the annulus pressure is contained by the valve member 134 in tubing nose 120 (FIG. 2), which is on the terminal end of hose 98. Pressure is also contained by the rams of BOP 82. Before engaging in cutting hose 98, it should be verified that the pressure downstream of BOP 82 is zero by checking the gage 88 on the outside of instrument flange 84 on BOP 82.

Figure 7:
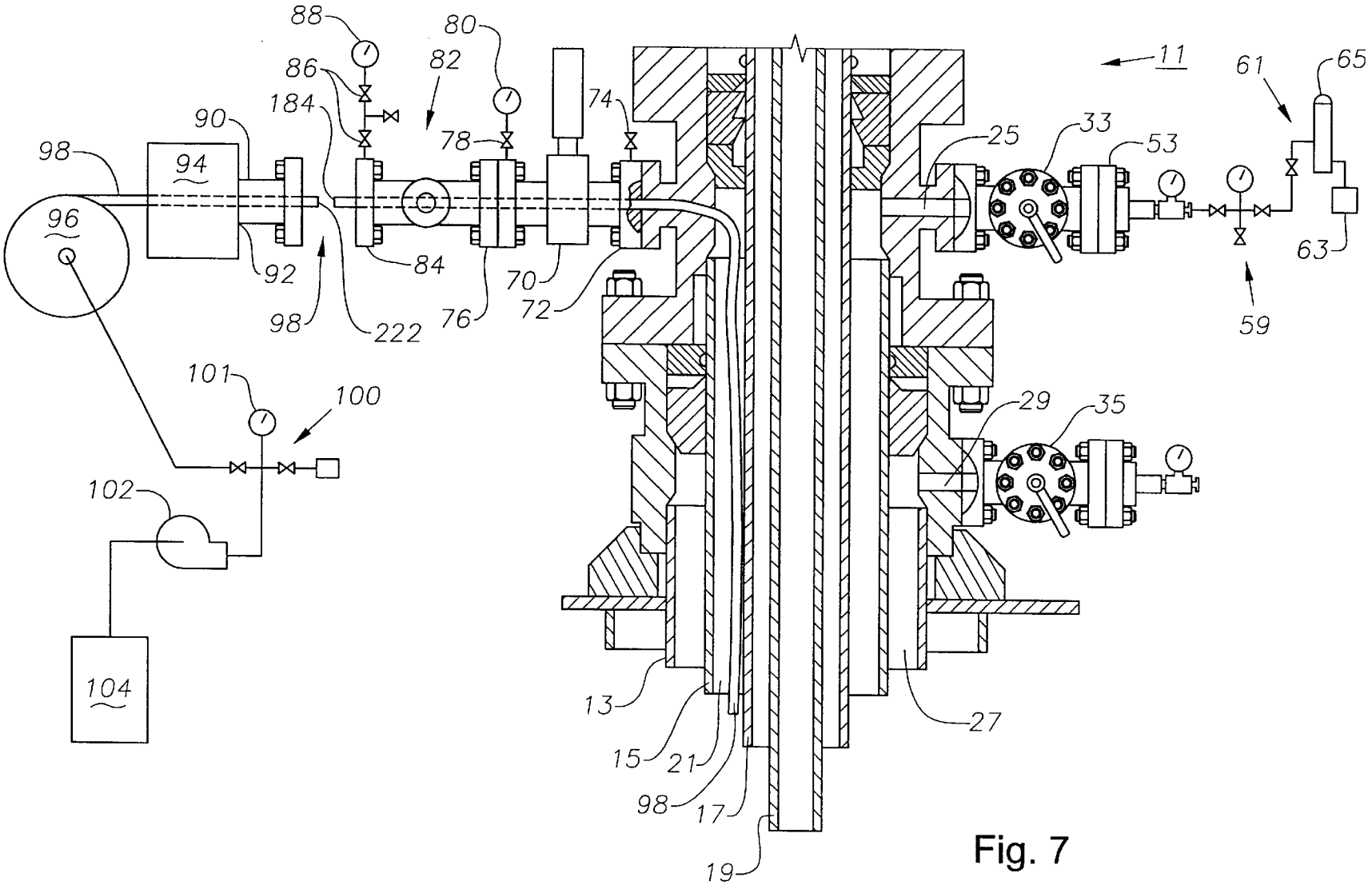
FIG. 7 is a sectional side view of the tubing head of FIGS. 1 and 2 and the remediation system of FIG. 2, showing a partial disassembly of the remediation system to expose the hose for cutting.

Before proceeding, the following steps should be conducted as rapidly as possible to minimize reliance on the check valve in tubing nose 120 and reliance on BOP 82. Referring now to FIG. 7, these steps include breaking the flange 84 between BOP 82 and packoff 90, then separating packoff 90 and BOP 82 enough to set packoff 90 and injector head 94 on the floor, which is typically approximately five feet below flange 84. The pressure on the inside of hose 98 should be verified as being zero at this time by checking pressure gage 101 on manifold 100. Hose 98 is then severed with a cutting device, approximately 4 inches beyond the end of flange 84 on BOP 82. By cutting, hose 98 is segmented into a reel section extending from reel 96 having a second cut end 222 and a section extending from tubing head 11 having a first cut end 184. The packoff 90 and head assembly 94 are then set aside (FIG. 7). A terminal fitting assembly 180 (FIG. 5) is then crimped onto the first cut end 184 of hose 98.

Terminal fitting assembly 180 and the swivel fitting attached to second cut end 222 are then connected so that the connection can then be tested. The connection is then tested by applying 500 PSI on the inside of hose 98, a pressure less than a threshold operating pressure of the spring 138 of tubing nose 120 (FIG. 3). There will be no discharge of water from hose 98 at this point. The pressure is then bled off. The reel section and tubing head section of hose 98 should then be disconnected by breaking off the connection between terminal fitting assembly 180 and the swivel fitting 220.

Figure 5:
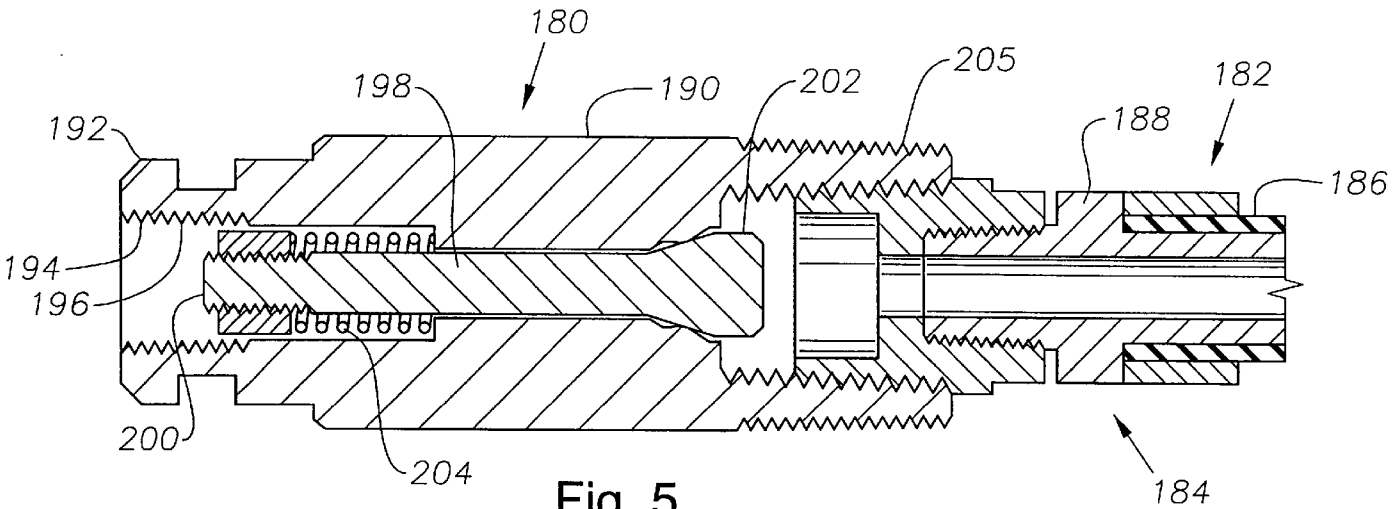
FIG. 5 is a sectional side view of a terminal fitting assembly connected to a first cut end of the hose of FIG. 2.

Valve removal tool 160 (FIG. 4) is then installed on BOP 82 for setting terminal fitting assembly 180 (FIG. 5). Pressure testing should again take place. The pressure should be bled out of needle valve 78 on flange 76 to equal the pressure on the other side of the BOP 82. BOP 82 should then be opened. Terminal fitting assembly 180 (FIG. 5) is threadably set in the profile of access port 23 (FIG. 1) of tubing head 11 with tool 160. Tool 160 inserts terminal assembly 180 through BOP into access port 23 where it is threadably received. The valve removal tool 160 should be backed off a few turns and pressure from the annulus 21 should then be bled off. The seal between terminal fitting assembly and port 23 should be verified at this time. The traveling stem 162 of valve removal tool 160 should be removed from the terminal fitting assembly and the valve removal tool 160 should then be disconnected from BOP 82.

Figure 8:
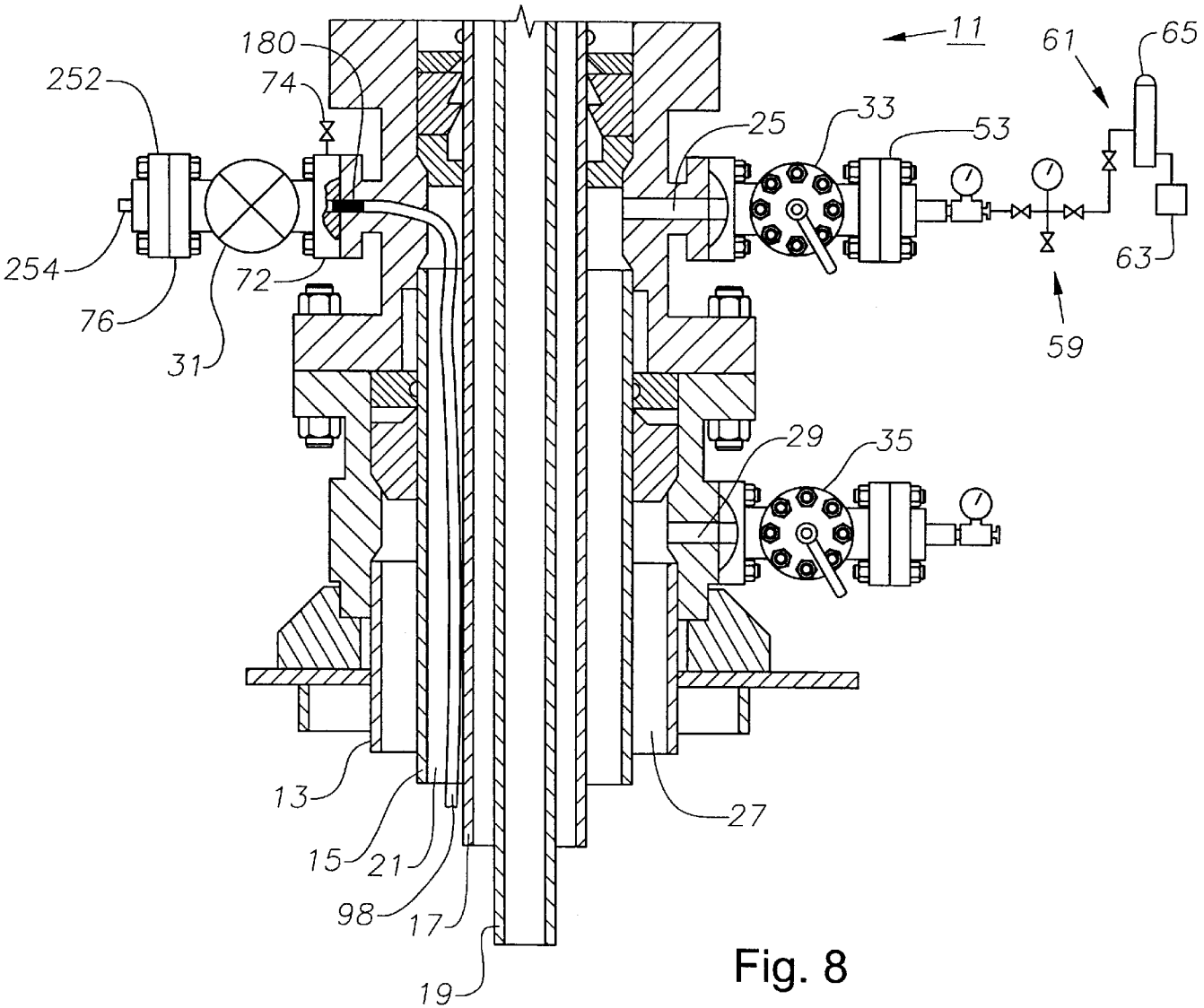
FIG. 8 shows the tubing head of FIG. 1 after installation of the terminal fitting assembly of FIG. 5.

Since access port 23 is sealed with terminal fitting assembly 180, the BOP 82 and shear valve 70 may then be removed, thereby exposing the installed terminal fitting assembly 180 that is visible within access port 23. Referring now to FIG. 8, a full opening manual gate valve, such as valve 31 may then be installed on tubing head 11 proximate access port 23. A companion flange 252 and a bull plug 254 are preferably installed for safety and to protect terminal fitting assembly 180. Bull plug 254 may be removed and a pump in line attached to companion flange 252. A heavy-weight media such as Zinc Bromide or any other fluids may then be pumped through valve 31, where pressure from the fluid will cause seating head 202 in terminal fitting assembly 180 (FIG. 5) to unseat thereby allowing fluids to flow down hose 98, through tubing nose 120 and into annulus 21 as needed. The pressure overcomes the force of spring 138 (FIG. 3) in tubing nose 120 to allow flow into annulus 21. Hose 98 will remain in place for future use.

The invention has significant advantages. By pressurizing small diameter elastomeric tubing, inexpensive elastomeric tubing may be used instead of large and expensive coiled tubing to inject fluids in a well annulus. Flexible tubing also has a relatively small bend radius to allow entry into restricted annuluses. Additionally, the tube may be left in the well to be used for casing annulus pressure remediation and annulus pressure remediation or periodically unloading the well, pumping chemicals, etc. The check valve in the surface terminal fitting serves as an extra barrier against pressure buildup.

While the invention has been shown in only one of its forms, it should be apparent to those skilled in the art that it is not so limited, but is susceptible to various changes without departing from the scope of the invention.

What is claimed is:

1. An apparatus for installation in a well to deliver a remediation fluid into said well, said well having a wellhead, with a laterally extending access port, said apparatus comprising:

a flexible hose having an upper end and a lower end;

a terminal fitting assembly on said upper end of said hose, said terminal fitting assembly adapted to seat and seal in said lateral access port;

a tubing nose on said lower end of said hose which has a closure member that is capable of holding a pressure to make said hose rigid, enabling said hose to be pushed down said well, wherein said closure member opens by increasing pressure in said hose to subsequently allow a remediation fluid to be pumped through said hose;

a valve adapted to be mounted to said wellhead outside of said terminal fitting assembly at said access port for opening and closing said access port; and a pump adapted to be operatively connected to said closure member for pumping said remediation fluid through said closure member and delivering said remediation fluid through said hose into said well.

2. An apparatus according to claim 1 wherein:

said terminal fitting assembly has a threaded outer diameter portion for screwing into said access port in said wellhead.

3. An apparatus according to claim 1 wherein:

said terminal fitting assembly has a check valve to prevent any pressure leakage from said upper end of said hose.

4. An apparatus according to claim 1 wherein:

said closure member is a pressure actuated valve.

5. In a well having a tubing head having at least one access port, and a casing string in said tubing head that defines a casing annulus surrounding said casing, and an access passage through said tubing head from said annulus, the improvement comprising:

a flexible elastomeric hose having an upper end, the hose passing through said access port and down said annulus to a selected depth;

terminal fitting assembly on said upper end of said hose, said terminal fitting assembly seated and sealed in said access port and having a check valve to prevent leakage of pressure out of said upper end of said hose; and a pump operatively engaged with said check valve and flexible hose for delivering a remediation fluid through said hose to displace the well fluid in said casing annulus.

6. The well according to claim 5 further comprising:

a valve mounted to said tubing head at said access port outside of said terminal fitting assembly.

7. The well according to claim 5 wherein:

said terminal fitting assembly is threaded into said access port in said tubing head.

8. The well according to claim 5 further comprising:

a tubing nose at a lower end of said flexible hose; and a valve member in said tubing nose for closing said lower end to allow internal pressure to cause the hose to become rigid to facilitate insertion, and wherein said valve member opens at a selected pressure to allow said remediation fluid to be delivered.

9. An apparatus for installation in a well to deliver a remediation fluid into said well, said well having a tubing head with a laterally extending access port, said apparatus comprising:

a flexible hose having an upper end and a lower end;

a tubing nose on said lower end of said hose which has a closure member that is capable of holding a pressure to make said hose rigid, enabling said hose to be pushed down said well, wherein said closure member opens by increasing pressure in said hose to subsequently allow a remediation fluid to be pumped through said hose;

a blow-out preventer adapted to be releasably mounted to said tubing head at said access port for closing around said hose in the event of an emergency;

a packoff mounted to said blow-out preventer for sealing around said hose as said hose is being inserted in said well;

a pump in communication with said hose to apply pressure to make said hose rigid to facilitate insertion into the well;

terminal fitting for installation on said upper end of said hose that reaches a desired depth, said terminal fitting adapted to seat and seal in said access port; and a valve for mounting to said tubing head at said access port after removal of said blow-out preventer and said packoff, said valve enabling said pump to discharge remediation fluid through said valve, said terminal fitting and said hose.

10. An apparatus according to claim 9 wherein:

said terminal fitting assembly has a check valve to prevent any pressure leakage from said upper end of said hose.

11. An apparatus according to claim 9 wherein:

said closure member is a pressure actuated valve.

12. A method of installing a conduit into a well having a wellhead having an access passage comprising the steps of:

(a) passing a flexible hose through said access passage into an upper end of the well;

(b) closing a lower end of said hose and pressurizing said hose to a first pressure to make said hose substantially rigid; then (c) pushing said hose downward in said well to a desired depth; then;

(d) securing a fitting to an upper end of said hose and sealingly securing the fitting in the access passage; then (e) pumping a fluid through said fitting into said hose;

(f) opening said lower end of said hose by increasing the pressure of the fluid within said hose; then (g) flowing said fluid out of said lower end of said hose.

13. The method of according to claim 12 wherein:

step (b) comprises placing a pressure responsive valve in said lower end of said hose; and step (f) comprises increasing said first pressure sufficiently to open said pressure responsive valve.

14. The method according to claim 12 wherein said well has at least two tubular conduits, defining an annulus between them and wherein steps (a) and (b) comprise inserting and pushing said hose down said annulus.

15. The method according to claim 12 wherein said fitting of step (d) has a check valve to prevent upward flow of fluid out of said hose.

16. The method according to claim 12 wherein said step of securing a fitting to an upper end of said hose further comprises the steps of:

cutting said hose; and securing said fitting to said hose.

17. The method according to claim 12 wherein said step of securing a fitting to an upper end of said hose further comprises the steps of:

providing said fitting with a threaded outer diameter portion;

cutting said hose;

securing said threaded outer diameter portion to a threaded section in said access passage; and wherein step (e) comprises the steps of installing a valve to said tubing head at said access passage outside of said fitting, then pumping through said valve and said fitting into said hose.

18. The method according to claim 12 further comprising the steps of:

prior to step (a) installing a blow-out preventer and a packoff to said access passage; and wherein step (d) comprises:

removing said packoff from said wellhead;

providing said fitting with a threaded outer diameter portion;

cutting said hose;

securing said threaded outer diameter portion to a threaded section in said access passage; and wherein step (e) comprises the steps of installing a valve to said wellhead at said access passage outside of said terminal fitting, then pumping through said valve and said fitting into said hose.

19. The method according to claim 12 wherein said step of securing a fitting to an upper end of said hose further comprises the steps of:

providing said fitting with a threaded outer diameter portion;

cutting said hose;

securing said outer diameter portion within said access passage; and wherein step (e) comprises the steps of installing a valve to said wellhead at said access passage outside of said fitting, then pumping through said valve and said fitting into said hose.

20. The method according to claim 12 further comprising the steps of:

prior to step (a) installing a blow-out preventer and a packoff to said access passage; and wherein step (d) comprises:

inserting said fitting through said blow-out preventer into said access passage and sealing said fitting in said access passage with threads;

removing said packoff from said wellhead;

providing said fitting with a threaded outer diameter portion;

cutting said hose;

securing said threaded outer diameter portion to a threaded section in said access passage; and wherein step (e) comprises the steps of installing a valve to said wellhead at said access passage outside of said fitting, then pumping through said valve and said fitting into said hose.

* * * * *

UNITED STATES PATENT AND TRADEMARK OFFICE

CERTIFICATE OF CORRECTION

PATENT NO. : 6,186,239 B1
DATED : February 13, 2001
INVENTOR(S) : Noel A. Monjure, et al.

It is certified that error appears in the above-identified patent and that said Letters Patent is hereby corrected as shown below:

Column 3,
Line 9, after "be" insert -- attached --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE
Certificate

Patent No. 6,186,239 Patented: February 13, 2001

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Noel A. Monjure, Houston, TX; Kenneth Sikes, Sr., Marrero, LA; David D. Comeaux, Sugarland, TX; Francis R. Bobbie, Houston, TX; Ralph Lewis Ropp, Dallas, TX; John M. Murphy, Marrero, LA; Michael J. Scott, Houston, TX; and Frank J. Ditta, Harvey, LA.

Signed and Sealed this Fourth Day of June 2002.

DAVID J. BAGNELL
*Supervisory Patent Examiner*
Art Unit 3672